US012686101B2

(12) United States Patent
Kanda et al.

(10) Patent No.: US 12,686,101 B2
(45) Date of Patent: Jul. 21, 2026

(54) BLASTING ABRASIVE AND MANUFACTURING METHOD THEREOF, BLASTING METHOD, AND BLASTING APPARATUS

(71) Applicant: SINTOKOGIO, LTD., Nagoya (JP)

(72) Inventors: Shinji Kanda, Nagoya (JP); Hiroki Mizuno, Nagoya (JP); Hayato Taniguchi, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 717 days.

(21) Appl. No.: 17/924,475

(22) PCT Filed: May 14, 2021

(86) PCT No.: PCT/JP2021/018465
§ 371 (c)(1),
(2) Date: Nov. 10, 2022

(87) PCT Pub. No.: WO2021/235361
PCT Pub. Date: Nov. 25, 2021

(65) Prior Publication Data

US 2023/0271301 A1 Aug. 31, 2023

(30) Foreign Application Priority Data

May 18, 2020 (JP) ..... 2020-086537

(51) Int. Cl.
*B24C 11/00* (2006.01)
*B24C 7/00* (2006.01)

(52) U.S. Cl.
CPC ..... *B24C 11/00* (2013.01); *B24C 7/0046* (2013.01)

(58) Field of Classification Search
CPC ..... B24C 11/00; B24C 11/005; B24C 7/0046
See application file for complete search history.

(56) References Cited

U.S. PATENT DOCUMENTS 5,234,470 A * 8/1993 Lynn ..... B24D 3/32 451/36
2006/0099888 A1* 5/2006 Ishibashi ..... B24C 1/00 451/38
2008/0233838 A1 9/2008 Mase et al.
2013/0023187 A1 1/2013 Mase et al.
(Continued)

FOREIGN PATENT DOCUMENTS

CN 102886743 A 1/2013
CN 104066547 A 9/2014
(Continued)

OTHER PUBLICATIONS

International Preliminary Report on Patentability issued Dec. 1, 2022 in WO Patent Application No. PCT/JP2021/018465.
(Continued)

*Primary Examiner* — Pegah Parvini
(74) *Attorney, Agent, or Firm* — Faegre Drinker Biddle & Reath LLP

(57) ABSTRACT

A blasting abrasive includes a particle of hot melt resin and abrasive grains to be firmly fixed to the particle, a blasting method further includes preparing a blasting abrasive including particles of hot melt resin and abrasive grains to be firmly fixed to the particles, heating gas, and injecting both the blasting abrasive and the heated gas.

3 Claims, 9 Drawing Sheets

(56) References Cited

U.S. PATENT DOCUMENTS

| | | | |
|---|---|---|---|
| 2013/0288945 | A1 | 10/2013 | Miyasaka |
| 2014/0329441 | A1 | 11/2014 | Mase et al. |
| 2016/0184969 | A1 | 6/2016 | Liu et al. |

FOREIGN PATENT DOCUMENTS

| | | | |
|---|---|---|---|
| JP | 2001-162995 | A | 6/2001 |
| JP | 2001-239595 | A | 9/2001 |
| JP | 2006-159402 | A | 6/2006 |
| JP | 2009-012111 | A | 1/2009 |
| JP | 2011-093046 | A | 5/2011 |
| JP | 2011-121120 | A | 6/2011 |
| JP | 2016-003597 | A | 1/2016 |
| JP | 2016-049619 | A | 4/2016 |
| JP | 2019-081211 | A | 5/2019 |
| TW | 534855 | B | 6/2003 |
| TW | 201024033 | A | 7/2010 |

OTHER PUBLICATIONS

Indonesian Office Action issued Jan. 31, 2025 in Application No. P00202214470.

Extended European Search Report issued Apr. 25, 2024 in Application No. 21808002.6.

Japanese Office Action issued Aug. 15, 2023 in Application No. P2020-086537.

Korean Office Action issued Nov. 21, 2025 in Application No. 10-2022-7042904.

* cited by examiner

*Fig.9*

| SURFACE TEMPERATURE OF HOT MELT RESIN | 20℃ | 30℃ | 40℃ | 50℃ |
|---|---|---|---|---|
| RUBBER HARDNESS(A) | 69 | 53.5 | 42 | 19 |

BLASTING ABRASIVE AND MANUFACTURING METHOD THEREOF, BLASTING METHOD, AND BLASTING APPARATUS

TECHNICAL FIELD

The present disclosure relates to a blasting abrasive and a manufacturing method thereof, a blasting method, and a blasting apparatus.

BACKGROUND ART

A blasting method for injecting a gas-particle two-phase flow consisting of an abrasive and gas from an injection nozzle to a workpiece to perform a surface treatment is widely known. Blasting is used for scale removal, surface fold removal, rust removal, coating film removal, backing processing, etc. of cast products. Furthermore, blasting has also been recently used in applications that require high processing accuracy, such as smooth finish and glossy finish.

Patent Literature 1 describes an abrasive to be used for blasting. This abrasive is obtained by coating a binder onto the surface of a core material, and sprinkling abrasive grains (abrasive powder) onto the binder so that the abrasive grains adhere to the surface. Alternatively, a mixture of abrasive grains and a binder is kneaded and attached to the surface of the core material.

CITATION LIST

Patent Document

Patent Document 1: Japanese Unexamined Patent Publication No. 2009-12111

SUMMARY OF INVENTION

Technical Problem

In the blasting disclosed in Patent Document 1, the processing ability depends on the hardness of the core material. Therefore, the abrasive is required to be manufactured according to the type of a workpiece and a target surface state. Further, in order to find optimum processing conditions, it is necessary to manufacture abrasives having core materials of various hardness by trial and error each time.

Further, the abrasive is reused many times in the blasting. In the abrasive of Patent Document 1, the abrasive grains are fixed only on the surface of the core material, so that if the abrasive grains are separated from the core material due to blasting, polishing ability is lost, and the abrasive grains cannot be reused. In other words, production of the abrasive and a replacement work of the abrasive for a blasting apparatus are frequently performed.

In view of the foregoing, the present disclosure provides a technique for efficiently performing blasting to bring a workpiece into a target surface state.

Solution to Problem

One aspect of the present disclosure is a blasting abrasive to be injected to a workpiece together with gas. The blasting abrasive includes a particle of hot melt resin, and abrasive grains to be firmly fixed to the particle.

The hardness of the particle of hot melt resin for firmly fixing the abrasive grains changes depending on the temperature. Therefore, when blasting is performed by using this blasting abrasive, the hardness of the blasting abrasive can be changed according to the temperature of the gas to be injected together with the blasting abrasive. Therefore, by using this blasting abrasive, blasting for bring a workpiece into a target surface state can be efficiently implemented.

In one embodiment, the hot melt resin may include any one of ethylene vinyl acetate and polyurethane as a main component.

In one embodiment, the abrasive grains may include abrasive grains that are firmly fixed in such a way as to be partially buried from a surface of the particle to an inside of the particle in a radial direction thereof, and exposed from the surface of the particle to an outside of the particle in the radial direction thereof. This blasting abrasive can reduce the amount of abrasive grains falling off from the particle as compared with a blasting abrasive in which the abrasive grains are in contact with and fixed to the surface of the particle.

In one embodiment, the abrasive grains may include abrasive grains which are firmly fixed in such a way as to be wholly buried in the particle, and the abrasive grains which are firmly fixed in such a way as to be wholly buried may be distributed more in a vicinity of the surface of the particle than in a center of the particle. In this case, the abrasive grains that are firmly fixed in such a way as to be wholly buried are newly exposed from the inside when the abrasive grains on the surface of the blasting abrasive are detached. This blasting abrasive can reduce the decrease in cutting force due to blasting as compared with the blasting abrasive in which the abrasive grains are fixed only on the surface.

Another aspect of the present disclosure is a manufacturing method of a blasting abrasive to be injected to a workpiece together with gas. This manufacturing method of a blasting abrasive includes the following steps.

(1) A step of producing a compound. In the compound, particles of hot melt resin and abrasive grains are blended in a predetermined weight ratio.
(2) A step of heating the compound to a temperature equal to or more than a melting point of the particles of hot melt resin.
(3) A step of cooling the compound to a temperature lower than the melting point of the particles.
(4) A step of removing the abrasive grains not firmly fixed to the particles of hot melt resin from the compound.

According to this manufacturing method, a blasting abrasive in which abrasive grains are firmly fixed to the particles of the hot melt resin can be obtained. The hardness of the particles of the hot melt resin changes depending on the temperature. Therefore, when blasting is performed by using this blasting abrasive, the hardness of the blasting abrasive changes depending on the temperature of the gas to be injected together with the blasting abrasive. Therefore, according to this manufacturing method, it is possible to manufacture a blasting abrasive for efficiently performing blasting to achieve a target surface state by adjusting the temperature of the gas.

Another aspect of the present disclosure is a blasting method for injecting a blasting abrasive to a workpiece together with gas. This blasting method includes the following steps.

(1) A step of preparing a blasting abrasive. The blasting abrasive includes particles consisting of hot melt resin and abrasive grains to be firmly fixed to the particles.
(2) A step of heating the gas.

(3) A step of injecting both the blasting abrasive and the heated gas.

According to this blasting method, the hardness of the particles of the hot melt resin for firmly fixing the abrasive grains changes depending on the temperature. Therefore, when blasting is performed by using this blasting abrasive, the hardness of the blasting abrasive changes depending on the temperature of the gas to be injected together with the blasting abrasive. Therefore, according to this blasting method, blasting for achieving a target surface state can be efficiently performed by adjusting the temperature of the gas.

Another aspect of the present disclosure is a blasting apparatus for injecting a blasting abrasive to a workpiece together with gas. This blasting apparatus includes a storage container, a heater, and a nozzle. The storage container stores a blasting abrasive (including particles consisting of hot melt resin and abrasive grains to be firmly fixed to the particles) including particles consisting of hot melt resin and abrasive grains to be firmly fixed to the particles. The heater heats the gas. The nozzle injects the blasting abrasive supplied from the storage container together with the gas heated by the heater.

According to this blasting apparatus, the hardness of the particles of the hot melt resin for firmly fixing the abrasive grains changes depending on the temperature. Therefore, when blasting is performed by using this blasting abrasive, the hardness of the blasting abrasive changes depending on the temperature of the gas to be injected together with the blasting abrasive. Therefore, according to this blasting apparatus, blasting for achieving a target surface state can be efficiently performed by adjusting the temperature of the gas.

Advantageous Effects of Invention

According to the technique related to the present disclosure, blasting for bringing a workpiece into a target surface state can be efficiently performed.

BRIEF DESCRIPTION OF DRAWINGS

FIG. 9 shows a measurement result showing the relationship between the temperature and the rubber hardness of hot melt resin.

DESCRIPTION OF EMBODIMENTS

Figure 1:
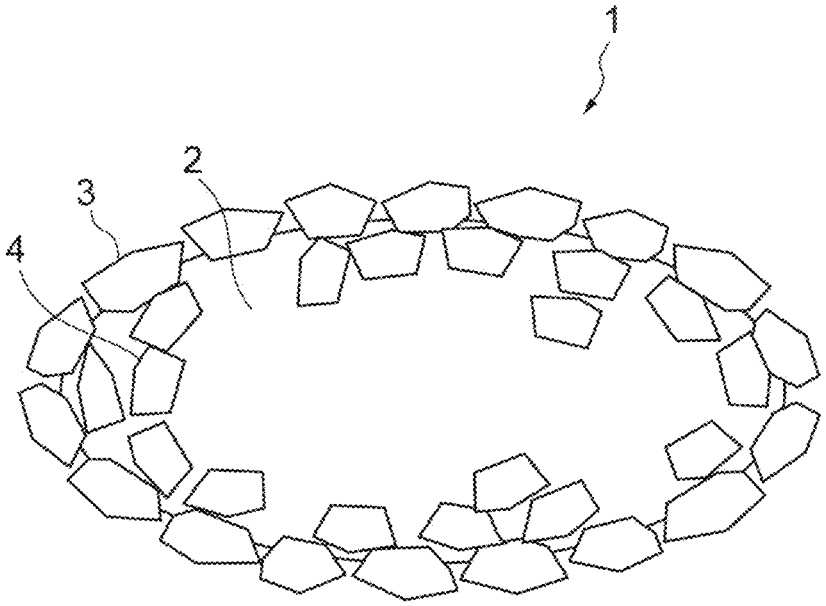
FIG. 1 is a cross-sectional view showing an example of a blasting abrasive according to an embodiment.

Embodiments of the present disclosure will be described hereunder with reference to the drawings. In the following description, the same or equivalent elements are designated by the same reference signs, and duplicate description thereon will not be repeated. The dimensional ratios in the drawings do not necessarily match those described. The terms "top," "bottom," "left," and "right" are based on the states shown in the figures and are used for convenience.

[Structure of Blasting Abrasive]

FIG. 1 is a cross-sectional view showing an example of a blasting abrasive 1 according to an embodiment. The blasting abrasive 1 includes a particle 2 consisting of hot melt resin, and abrasive grains 3 to be firmly fixed to the particle 2.

The hot melt resin is a resin having thermoplasticity. The hot melt resin is solid (solid phase) at room temperature, and it melts and becomes liquid (liquid phase) at a temperature equal to or more than the melting point. The hot melt resin is bonded to another material by changing the hot melt resin to a solid phase in a state where the hot melt resin in liquid phase is brought into contact with the other material.

As an example, the hot melt resin adoptable for the particles 2 can be made as a material having a melting point of 60° C. or more and 100° C. or less. If the melting point is less than 60° C., there is a risk that it turns into liquid phase during blasting. If the melting point exceeds 100° C., a fixing step for the abrasive grains 3 may take a high cost, and the softening point thereof tends to be high, which may make it difficult to control the rubber elasticity. The softening point is a temperature at which the hot melt resin begins to soften. Further, the hot melt resin adoptable for the particles 2 can be made as a material whose rubber elasticity changes according to the temperature in the temperature range of 80° C. or less. For example, it can be made as a material in which the change in rubber hardness is 1.3 (A) or more with respect to a temperature change of 1° C. in the temperature range of 20° C. to 50° C.

The hot melt resin satisfying the above-mentioned conditions may contain, as an example, ethylene vinyl acetate, polyurethane, low-density polyethylene, polyester, polyamide, polyolefin, ionomer, or polyvinyl alcohol as a main component. With respect to the hot melt resin including ethylene vinyl acetate as a main component, the melting point thereof is in the range of 60° C. to 97° C., and the softening point thereof is 69° C. or less (when the melting point is 60° C., the softening point is 40° C. or less). With respect to the hot melt resin including polyurethane as a main component, the melting point thereof is 90° C.

The particles 2 are particles in which the hot melt resin is pulverized at a particle size in a predetermined range. The shape of the particles 2 may be spherical, plate-shaped, columnar, conical, or polyhedral. The particle size of the particles 2 may be in the range of 50 μm to 1000 μm. The particles 2 may include a hot melt resin as a main component, and may include a resin other than the hot melt resin or other components.

The abrasive grains 3 are particles in which a raw material harder than a raw material to be blasted is pulverized at a particle size in a predetermined range. The raw material of the abrasive grains 3 may include, as a raw material, alumina, silicon carbide, cerium oxide, tungsten carbide, zirconia, boron carbide, diamond or the like. The abrasive grains 3 may be powder having a predetermined average particle size. The average particle size is a median diameter (D50), and indicates a distribution of the particle size. The average particle size of the abrasive grains 3 may be 20 μm or less, or 10 μm or less.

The abrasive grains 3 are firmly fixed to the particle 2. "Firmly fixed" means that an object to be firmly fixed and a melted substance come into close contact with each other, and the melted substance solidifies and adheres to the object. The abrasive grains 3 and the particle 2 melted by heat come into close contact with each other, and the particle 2 is solidified by cooling, so that the abrasive grains 3 adhere to the particle 2. The abrasive grains 3 may be firmly fixed onto the surface of the particle 2 or the inside of the particle 2 in a radial direction of the particle 2. The abrasive grains 3 may be firmly fixed in such a way as to be partially buried from the surface of the particle to the inside of the particle 2 in the radial direction thereof and exposed from the surface of the particle 2 to the outside of the particle 2 in the radial direction thereof. The abrasive grains 4 (3) may be firmly fixed in such a way as to be wholly buried in the particle 2. In this case, the abrasive grains 4 (3) which are firmly fixed in such a way as to be wholly buried in the particle 2 are distributed more in the vicinity of the surface of the particle 2 than in the center of the particle 2.

When the abrasive grains 4 (3) firmly fixed in such a way as to be wholly buried in the particle 2 are distributed more in the vicinity of the surface of the particle 2 than in the center of the particle 2, the abrasive grains 3 firmly fixed in such a way as to be wholly buried are newly exposed from the inside when the surface of the blasting abrasive 1 is worn. Further, a blasting abrasive 1 in which the abrasive grains 3 are distributed more in the vicinity of the surface of the particle 2 is higher in cutting force and larger in elasticity limit than a blasting abrasive in which the abrasive grains 3 are uniformly distributed inside the particle 2.

As described above, according to the blasting abrasive 1 related to the embodiment, the hardness of the particle 2 of the hot melt resin for firmly fixing the abrasive grains changes depending on the temperature. When blasting is performed using the blasting abrasive 1, the hardness of the blasting abrasive 1 changes depending on the temperature of a gas to be injected together with the blasting abrasive 1. Therefore, by using the blasting abrasive 1, it is possible to efficiently implement blasting for bringing a workpiece into a target surface state by adjusting the temperature of the gas.

The blasting abrasive 1 can reduce the amount of abrasive grains falling off from the particle 2 as compared with the blasting abrasive in which the abrasive grains 3 are in contact with and fixed to the surface of the particle 2.

The abrasive grains 3 firmly fixed in such a way as to be wholly buried are newly exposed from the inside when the surface of the blasting abrasive 1 is worn. This blasting abrasive 1 can reduce deterioration in cutting force caused by wearing as compared with a blasting abrasive that does not include the abrasive grains 3 firmly fixed in such a way as to be wholly buried in the particle 2.

[Method for Manufacturing Blasting Abrasive]

Figure 2:
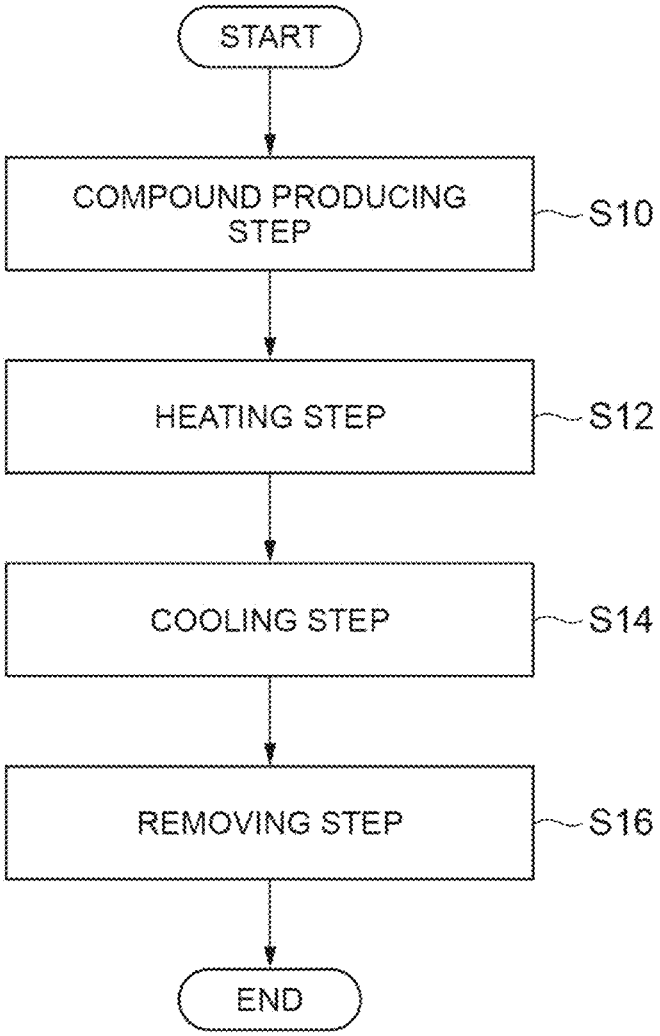
FIG. 2 is a flowchart showing an example of a manufacturing method of a blasting abrasive according to an embodiment.

FIG. 2 is a flowchart showing an example of a manufacturing method of the blasting abrasive 1 according to an embodiment. First, as a compound producing step (step S10), a compound in which the particles 2 and the abrasive grains 3 are blended in a predetermined weight ratio is produced. The compound may include not only the particles 2 consisting of one kind of hot melt resin, but also the particles 2 consisting of different kinds of hot melt resin. The compound may include not only the abrasive grains 3 consisting of one kind of raw material, but also the abrasive grains 3 consisting of different kinds of raw materials.

Next, as a heating step (step S12), the compound is heated to a temperature equal to or more than the melting point of the particles 2. The particles 2 begin to turn into liquid phase by heating. The abrasive grains 3 come into close contact with the surfaces of the particles 2 that have begun to turn into liquid phase. The abrasive grains 3 diffuse from the surfaces of the particles 2 into the particles 2 according to a heating time. The distribution of the abrasive grains 3 inside the particle 2 may be controlled based on the heating time, the heating temperature and the raw material of the particles 2.

Next, as a cooling step (step S14), the compound is cooled to a temperature lower than the melting point of the particles 2. The abrasive grains 3 are firmly fixed to the particles 2 that have turned from liquid phase into solid phase.

Finally, as a removing step (step S16), the abrasive grains 3 which are not firmly fixed to the particles 2 are removed from the compound. The abrasive grains 3 are removed by a sieve, a classifier, or the like. The compound becomes the blasting abrasive 1 by removing the abrasive grains 3 which are not firmly fixed to the particles 2. The flowchart shown in FIG. 2 is completed by the above. The blasting abrasive 1 is manufactured by the manufacturing method shown in FIG. 2

As described above, according to the manufacturing method related to the embodiment, it is possible to manufacture a blasting abrasive 1 that can efficiently implement blasting for bringing a workpiece into a target surface state by adjusting the temperature of gas.

[Blasting Method and Blasting Apparatus]

Figure 3:
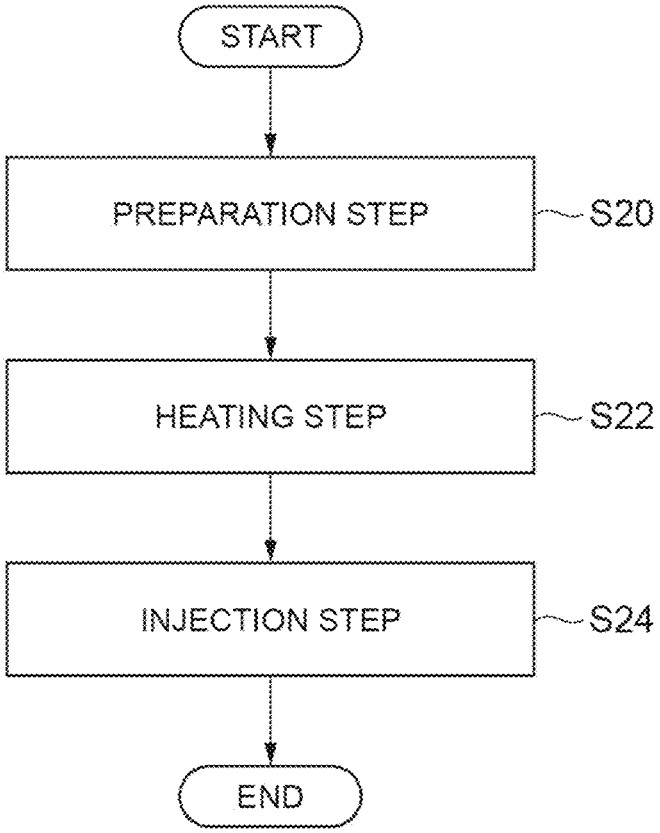
FIG. 3 is a flowchart showing an example of a blasting method according to an embodiment.
Figure 4:
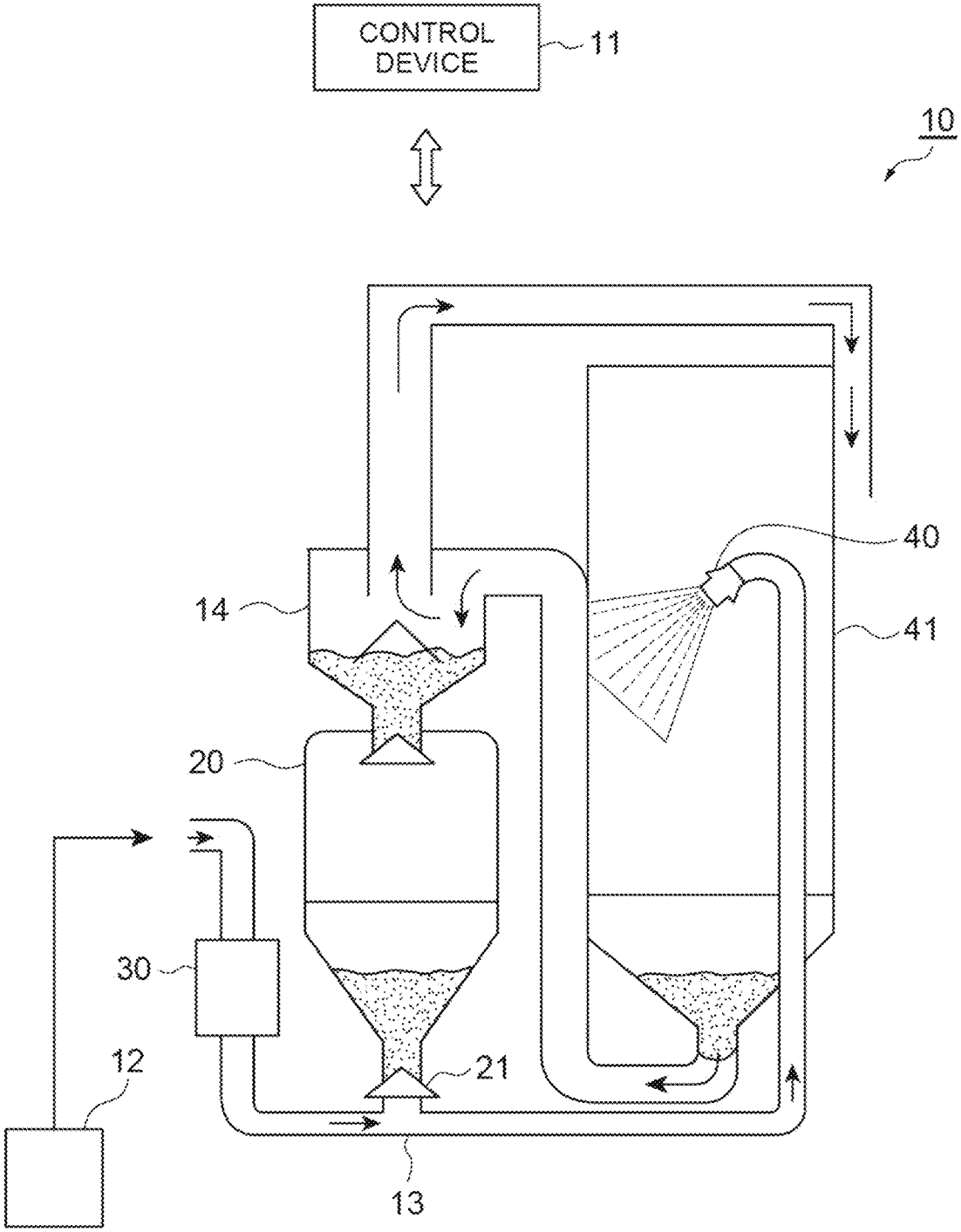
FIG. 4 is a schematic diagram showing an example of a blasting apparatus according to an embodiment.

FIG. 3 is a flowchart showing an example of a blasting method according to an embodiment. FIG. 4 is a schematic diagram showing an example of a blasting apparatus 10 according to an embodiment. The blasting method is executed by the blasting apparatus 10 using the blasting abrasive 1. The blasting apparatus 10 shown in FIG. 4 is a suction type (gravity type) blasting apparatus 10. First, the blasting apparatus 10 shown in FIG. 4 will be described.

As shown in FIG. 4, the blasting apparatus 10 includes a storage container 20, a heater 30, and a nozzle 40. The storage container 20 defines a space for storing the blasting abrasive 1 therein, and stores the blasting abrasive 1. The blasting abrasive 1 is supplied to the storage container 20 from the outside. For example, an operator may supply the blasting abrasive 1 to the storage container 20. The storage container may reuse a part of the blasting abrasive 1 that has been used for the blasting. In this case, the storage container 20 is supplied with the blasting abrasive 1 that has been used for the blasting from a classification mechanism 14 described later. The storage container 20 is connected to the nozzle 40 via a fixed quantity supply unit 21 and a pipe 13. The fixed quantity supply unit 21 is a device for sending the blasting abrasive 1 stored in the storage container 20 to the pipe 13, and it is, as an example, a screw feeder.

A gas supply source 12 for supplying gas is connected to the pipe 13. Examples of the gas supply source 12 include a compressor and a gas cylinder for supplying a gas under medium pressure (for example, 0.1 to 0.6 MPa), and a blowing machine such as a fan or a blower for supplying a gas under low pressure (for example, 0.01 to 0.1 MPa). In the present embodiment, compressed air is supplied by a compressor. The gas supplied from the gas supply source 12 to the pipe 13 conveys the blasting abrasive 1 sent out by the fixed quantity supply unit 21 to the nozzle 40.

The heater 30 is a device for heating the gas in the pipe 13. Examples of the heater 30 include a nichrome wire, a ceramic heater, a ribbon heater, an oil heater, and a heat-exchanger. The heater 30 may be provided on the outer wall of the pipe 13, or may be provided inside the pipe 13. The heater 30 is provided upstream of a delivery position by the fixed quantity supply unit 21 in the pipe 13. In this case, the contact time between the heated gas and the blasting abrasive 1 can be lengthened as compared with a case where the heater 30 is provided downstream of the delivery position by the fixed quantity supply unit 21, so that the adjustment range of the hardness of the blasting abrasive 1 can be expanded. The heater 30 may be provided downstream of the delivery position by the fixed quantity supply unit 21 in the pipe 13.

The nozzle 40 injects the blasting abrasive 1 supplied from the storage container 20 together with the gas heated by the heater 30. The nozzle 40 is accommodated in a processing chamber 41, and a gas-particle two-phase flow in which the blasting abrasive 1 supplied from the storage container 20 and the gas heated by the heater 30 are mixed with each other is supplied via the pipe 13. The nozzle 40 injects the blasting abrasive 1 together with the gas to a workpiece W (FIG. 5 to FIG. 7) arranged in the processing chamber 41. As a result, the workpiece W is blasted. The workpiece W may be supported by a table (not shown), and the position thereof may be adjusted by a table drive mechanism.

A lower part of the processing chamber 41 is connected to the storage container 20 via the classification mechanism 14. The blasting abrasive 1 and chips of the workpiece W that have fallen to the lower part of the processing chamber 41 are sucked by a dust collector (not shown) and pass through the classification mechanism 14. The classification mechanism 14 classifies them into the reusable blasting abrasive 1 and other fine powder (crushed blasting abrasive 1, chips of the workpiece W, etc.). The other fine powder is collected in the dust collector. The lower part of the classification mechanism 14 is connected to an upper part of the storage container 20. The reusable blasting abrasive 1 is supplied from the classification mechanism 14 to the storage container 20. When the blasting abrasive 1 is not reused, the blasting apparatus may not include the classification mechanism 14.

The blasting apparatus 10 is controlled by a control device 11. The control device 11 is configured, for example, as a Programmable Logic Controller (PLC). The control device 11 may be configured as a computer system including a processor such as a Central Processing Unit (CPU), a memory such as a Random Access Memory (RAM) and a Read Only Memory (ROM), an input/output device such as a touch panel, a mouse, a keyboard, and a display, and a communication device such as a network card. The control device 11 implements the function of the control device 11 by operating each hardware under the control of the processor based on a computer program stored in the memory. For example, the control device 11 controls the pressure of the gas in the gas supply source 12. The control device 11 controls the amount of the blasting abrasive 1 which the fixed quantity supply unit 21 sends out. The control device 11 operates the heater 30 to control the temperature of the gas. The control device 11 may control the temperature of the gas based on a temperature sensor (not shown) provided to the pipe 13 or the nozzle 40. The control device 11 may determine the temperature of the gas based on at least one of the relationship between the hardness of the particles 2 and the temperature and the temperature of the gas in the nozzle 40. The control device 11 may move the table for supporting the workpiece W to adjust the distance between the nozzle 40 and the workpiece W. The control device 11 may control at least one of the injecting amount of the blasting abrasive 1, the pressure at which the blasting abrasive 1 is injected, the temperature of the gas for injecting the blasting abrasive 1, and the distance between the nozzle 40 and the work piece W.

Next, a blasting method by the blasting apparatus 10 described above will be described. As shown in FIG. 3, first, as a preparation step (step S20), the blasting abrasive 1 is prepared. "Preparation" means that a predetermined amount of blasting abrasive 1 is stored in the storage container 20.

Next, as a heating step (step S22), the gas is heated. The temperature of the gas increases due to heating by the heater 30. The gas heated by the heater 30 becomes an air flow flowing from the pipe 13 to the nozzle 40. The blasting abrasive 1 is supplied from the fixed quantity supply unit 21 to the air flow of the heated gas flowing to the nozzle 40. The hardness of the blasting abrasive 1 changes depending on the temperature of the gas.

Finally, as a injecting step (step S24), the prepared blasting abrasive 1 and the heated gas are both injected. The nozzle 40 injects both the blasting abrasive 1 and the heated gas. When the injecting step (step S24) is completed, the flowchart shown in FIG. 3 ends. The blasting abrasive 1 is injected with arbitrary hardness by the blasting method shown in FIG. 3.

The control device 11 adjusts the hardness of the blasting abrasive 1 by adjusting the heating temperature of the heater 30. As an example, the control device 11 sets the temperature of the blasting abrasive 1 in three temperature ranges of a low temperature region, a medium temperature region, and a high temperature region, and adjusts the hardness of the blasting abrasive 1. The low temperature region, the medium temperature region, and the high temperature region are set in such a manner as to be increased in temperature in order. The high temperature region is set in a range lower than the melting point of the hot melt resin of the blasting abrasive 1. Any of the low temperature region, the medium temperature region, and the high temperature region may be set in a range including the softening point of the hot melt resin of the blasting abrasive 1.

Figure 5:
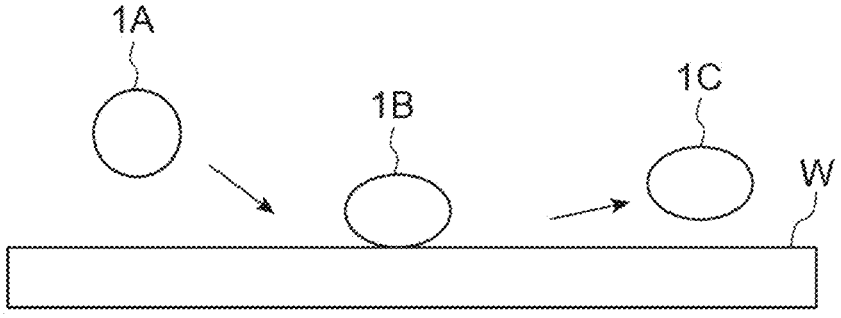
FIG. 5 is a schematic diagram showing an example of a case where a blasting abrasive at a temperature set in a low temperature region collides with a workpiece.

FIG. 5 is a schematic diagram showing an example of a case where the blasting abrasive 1 at a temperature set in the low temperature region collides with the workpiece W. FIG. 5 shows a change in shape of the blasting abrasive during a period of time from collision of the blasting abrasive 1 with the workpiece W until rebound of the blasting abrasive 1. The blasting abrasive 1 at a temperature set in the low temperature region is higher in hardness than the blasting abrasives 1 at temperatures set in the medium temperature region and the high temperature region.

A blasting abrasive 1A is a blasting abrasive 1 injected from the nozzle 40 to the workpiece W. The blasting abrasive 1A is, for example, a sphere before the collision. The blasting abrasive 1A collides with the workpiece W at a predetermined speed and a predetermined incident angle. The speed of the blasting abrasive 1A is determined based on the pressure of the gas, the shape of the nozzle 40, and the distance between the nozzle 40 and the workpiece W. The incident angle of the blasting abrasive 1A is determined based on the inclination angle of the nozzle 40 with respect to the workpiece W and the shape of the nozzle 40. The speed and the incident angle can be changed as a blast condition.

A blasting abrasive 1B is a blasting abrasive 1 colliding with the workpiece W. The shape of the blasting abrasive 1 is deformed from a sphere to an ellipsoid due to collision. A part of the kinetic energy of the blasting abrasive 1A is used for deformation of the blasting abrasive 1 and polishing of the workpiece W due to friction. The blasting abrasive 1B is harder and smaller in amount of deformation than the blasting abrasives 1 at temperatures set in the medium temperature region and the high temperature region. Therefore, the blasting abrasive 1B at a temperature set in the low temperature region more strongly polishes the workpiece W than the blasting abrasives 1 at temperatures set in the medium temperature region and the high temperature region.

The blasting abrasive 1C is a blasting abrasive 1 that has collided with the workpiece W and rebounded therefrom. The speed of the blasting abrasive 1C changes according to the amount of deformation of the blasting abrasive 1B. The blasting abrasive 1C falls to the lower part of the processing chamber 41.

Figure 6:
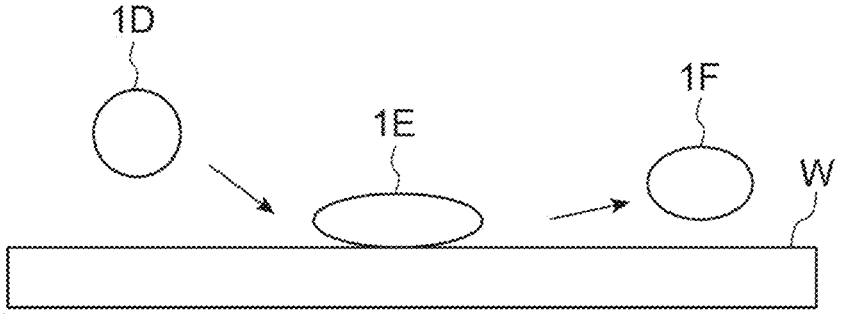
FIG. 6 is a schematic diagram showing an example of a case where a blasting abrasive at a temperature set in a medium temperature region collides with a workpiece.
Figure 7:
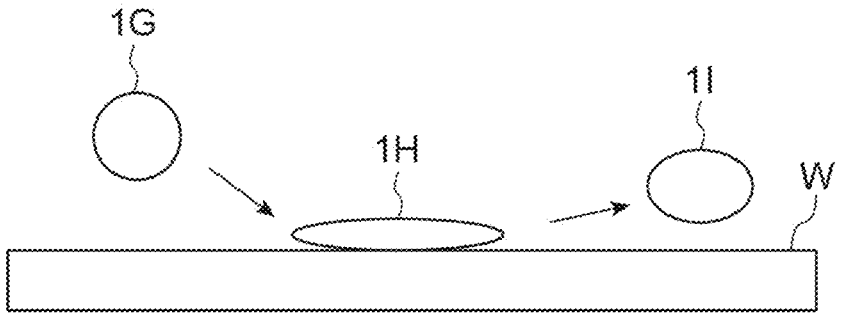
FIG. 7 is a schematic diagram showing an example of a case where a blasting abrasive at a temperature set in a high temperature region collides with a workpiece.

FIG. 6 is a schematic view showing an example of a case where the blasting abrasive 1 at a temperature set in the medium temperature region collides with the workpiece W. FIG. 7 is a schematic diagram showing an example of a case where the blasting abrasive 1 at a temperature set in the high temperature region collides with the workpiece W. The difference between FIGS. 6 and 7 and FIG. 5 is only the temperature of the blasting abrasive 1. In the following, the differences from FIG. 5 will be mainly described, and common description will be omitted.

The blasting abrasive 1 shown in FIG. 6 is higher in temperature than the blasting abrasive 1 according to FIG. 5. Therefore, the blasting abrasive 1 according to FIG. 6 is softer than the blasting abrasive 1 according to FIG. 5. Therefore, a blasting abrasive lE at a temperature set in the medium temperature region is larger in the amount of deformation under collision than the blasting abrasive 1B at a temperature set in the low temperature region. Therefore, the blasting abrasive 1 at a temperature set in the medium temperature region more weakly polishes the workpiece W than the blasting abrasive 1 at a temperature set in the low temperature region.

The blasting abrasive 1 shown in FIG. 7 is higher in temperature than the blasting abrasive 1 according to FIG. 6. Therefore, the blasting abrasive 1 according to FIG. 7 is softer than the blasting abrasive 1 according to FIG. 6. Therefore, a blasting abrasive 1H at a temperature set in the high temperature region is larger in the amount of deformation under collision than the blasting abrasive lE at a temperature set in the medium temperature region. Therefore, the blasting abrasive 1 at a temperature set in the high temperature region more weakly polishes the workpiece W than the blasting abrasive 1 at a temperatures set in the low temperature region or the medium temperature region. The strength of polishing the workpiece W is adjusted as a blast condition.

As described above, the blasting method and the blasting apparatus 10 according to the embodiments can perform blasting for bringing the workpiece into a target surface state by adjusting the temperature of the gas. In other words, a new adjustment parameter such as the temperature of gas is introduced into the blast condition, and other blast conditions (the injection pressure, the incident angle of the blasting abrasive 1A, the distance between the workpiece W and the nozzle 40, etc.) are combined and appropriately adjusted, which makes it possible to implement blasting for bringing a workpiece into a target surface state.

[Modifications]

Although various exemplary embodiments have been described above, various omissions, substitutions, and changes may be made without being limited to the above exemplary embodiments.

The abrasive grains 3 may be firmly fixed in such a way as to be partially buried from the surface of the particle 2 to the inside of the particle 2 in the radial direction thereof, and may not include the abrasive grains 3 exposed from the surface of the particle 2 to the outside of the particle 2 in the radial direction thereof. The particles 2 may not include particles 2 in which the abrasive grains 3 are firmly fixed in such a way as to be wholly buried. The abrasive grains 3 firmly fixed in such a way as to be wholly buried are not necessary to be distributed more in the vicinity of the surface of the particle 2 than in the center of the particle 2.

Figure 8:
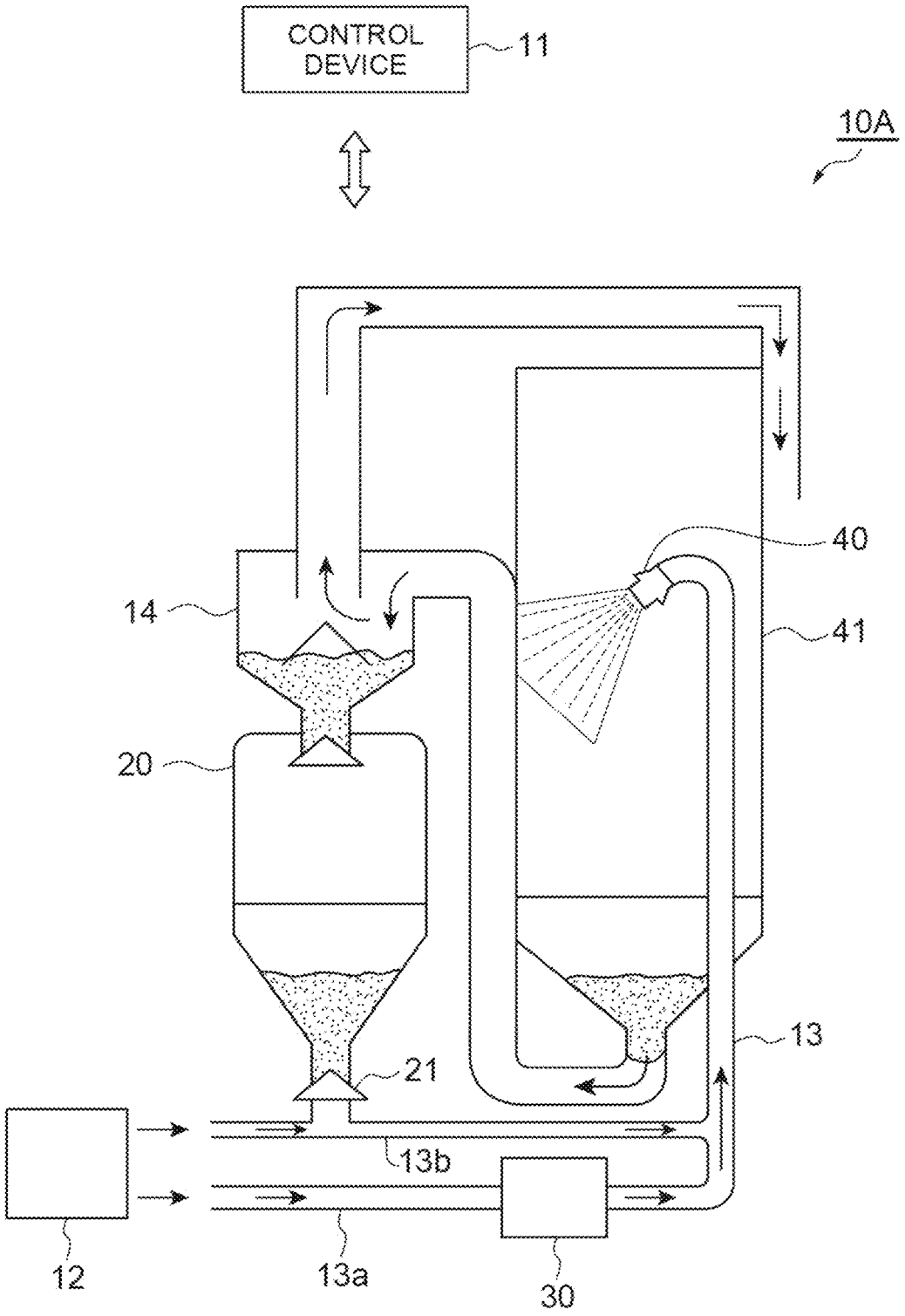
FIG. 8 is a schematic diagram showing an example of a blasting apparatus according to another embodiment.

FIG. 8 is a schematic view showing an example of a blasting apparatus 10A according to another embodiment. The blasting apparatus 10A is a direct pressure type (pressurization type) blasting apparatus. In the following, the differences between the blasting apparatus 10 according to FIG. 8 and the blasting apparatus 10 according to FIG. 4 will be mainly described, and common description will be omitted.

In the blasting apparatus 10A, the gas supply source 12 is connected to a conduit 13*a* and an auxiliary pipe 13*b*. The blasting apparatus 10A may include a plurality of gas supply sources 12. In this case, different gas supply sources 12 are connected to the conduit 13*a* and the auxiliary pipe 13*b*. The conduit 13*a* and the auxiliary pipe 13*b* are connected to the pipe 13. The injection pressure of the blasting apparatus 10A is mainly determined by the pressure of the gas to be supplied from the conduit 13*a* to the nozzle 40. The blasting abrasive 1 is supplied to the pipe 13 by a gas flowing through the auxiliary pipe 13*b*. The heater 30 is provided to the conduit 13*a*. The heater 30 heats a gas flowing through the conduit 13*a*. The heated gas flowing through the conduit 13*a* forms a gas flow to be supplied to the pipe 13 and injected from the nozzle 40. The blasting abrasive 1 is supplied from the auxiliary pipe 13*b* to the gas flow which flows to the nozzle 40 and is heated by the heater 30. The nozzle 40 injects the blasting abrasive 1 supplied from the auxiliary pipe 13*b* together with the gas heated by the heater 30.

A separation step of separating the blasting abrasive 1 larger than a predetermined size may be included in at least one of a pre-step and a post-step of the removing step (step S16). Agglomerated particles 2 in which particles 2 and other particles 2 are melted and integrated into one bodies are separated. The agglomerated particles 2 are removed by a sieve, a classifier, or the like.

The heating step (step S22) may be performed after the blasting abrasive 1 is supplied to the gas flowing through the pipe 13. There may be a plurality of heating steps (step S22). The heated gas may be supplied to the storage container 20.

The control device 11 may adjust the hardness of the blasting abrasive 1 according to the blast condition. In this case, the control device 11 may adjust the temperature of the gas based on the relationship between the hardness of the particles 2 and the temperature. The control device 11 is not limited to setting the temperature of the blasting abrasive in three temperature regions of a low temperature region, a medium temperature region, and a high temperature region. The control device 11 may set the temperature of the blasting abrasive in two temperature regions of a low temperature region and a high temperature region, or may set the temperature of the blasting abrasive in four or more temperature regions.

The heater 30 may be provided to the auxiliary pipe 13*b*. The blasting apparatus 10 may be a wet type blasting apparatus. In this case, a water supply pipe for supplying water to the pipe 13 or the conduit 13*a* is connected. In this case, the nozzle 40 injects the blasting abrasive 1, gas and water.

EXAMPLES

Hereinafter, examples to be carried out by the present inventor in order to describe the above effects will be described.

Example 1

The blasting abrasive 1 was manufactured by the manufacturing method described in the embodiment. First, a compound in which particles 2 using hot melt powder PR8050C of ethylene vinyl acetate copolymer manufactured by Tokyo Printing Ink Mfg. Co., Ltd. and abrasive grains 3 using silicon carbide (SiC) powder GP #2000 manufactured by Shinano Electric Refining Co., Ltd. were blended in the same weight ratio was produced (step S10). The softening point of the hot melt powder PR8050C is 40° C. or less, and the melting point thereof is 60° C. This compound was heated to 65° C. and then cooled (step S12, step S14). Subsequently, the SiC powder GP #2000 that did not adhere to the particles 2 was removed by a sieve (step S16) to produce a blasting abrasive 1.

Example 2

A blasting abrasive 1 using cerium-oxide-based abrasive SHOROX A-0 manufactured by Showa Denko K.K. as the abrasive grains 3 was produced. Other materials and a manufacturing method are the same as in Example 1.

[Confirmation of Controllability of Hardness of Blasting Abrasive]

The controllability of the hardness of the blasting abrasive 1 was confirmed by using the blasting abrasive 1 according to Example 1. The rubber hardness of the hot melt powder PR8050C was measured in a temperature range (the range of 20° C. to 50° C.) lower than 60° C., which is the melting point of the hot melt powder PR8050C. Since the softening point of the hot melt powder PR8050C is 40° C. or less, the above temperature range includes at least a temperature equal to or more than the softening point. The rubber hardness when the hot melt powder PR8050C was at 20° C., 30° C., 40° C., and 50° C. was measured as a measurement within the temperature range. Associating these temperatures with the description with reference to FIG. 5 to FIG. 7, 20° C. corresponds to the low temperature region, 30° C. and 40° C. correspond to the medium temperature region, and 50° C. corresponds to the high temperature region. The measurement of the rubber hardness was performed using a type A durometer. A result is shown in FIG. 9.

FIG. 9 is a measurement result showing the relationship between the temperature and the rubber hardness of the hot melt resin. As shown in FIG. 9, when the surface temperature of the particles 2 was 20° C. (corresponding to the low temperature region), the rubber hardness of the particles 2 indicated 69 (A). When the surface temperature of the particle 2 was 30° C. (corresponding to the medium temperature region), the rubber hardness of the particles 2 indicated 53.5 (A). When the surface temperature of the particle 2 was 40° C. (corresponding to the medium temperature region), the rubber hardness of the particles 2 indicated 42 (A). When the surface temperature of the particles 2 was 50° C. (corresponding to the high temperature region), the rubber hardness of the particles 2 indicated 19 (A). As shown in FIG. 9, it was confirmed that the rubber hardness decreased by increasing the temperature in the temperature range of the melting point of the hot melt resin or less. It was confirmed that by adopting the hot melt resin, the change in rubber hardness was about 1.3 (A) with respect to the temperature change of 1° C. in the temperature range of 20° C. to 50° C. As described above, it was confirmed that the hardness of the blasting abrasive 1 could be controlled in a relatively low temperature range of 20° C. to 50° C. In other words, it was confirmed that a new adjustment parameter can be introduced into the blast conditions.

[Confirmation of Flattening Processing by Blasting]

The blasting apparatus 10 was filled with the blasting abrasive 1 according to Example 1 to perform blasting on a workpiece W, and the surface roughness (arithmetic surface roughness: Ra) of the workpiece W was measured before and after the blasting. A gear of a hardening material (material: chrome molybdenum steel) that had been subjected shot peening by a steel shot SBM300 manufactured by Shintokogio, Ltd. was prepared as the workpiece W. A direct pressure type sandblasting apparatus ELP-3TR manufactured by Shintokogio, Ltd. was used as the blasting apparatus 10. First, the blasting abrasive 1A was stored in the blasting apparatus 10 (step S20). Next, the gas (compressed air) was heated to 90° C. (step S22). Finally, the blasting abrasive 1 according to Example 1 was injected onto the workpiece W with a heated gas of 0.2 MPa (step S24).

The surface roughness of the workpiece W changed from Ra0.73 to Ra0.36 before and after blasting. It was confirmed that the workpiece W could be flattened by applying the blasting abrasive 1 according to Example 1 to the blasting apparatus 10 and performing blasting.

[Confirmation of Glossy Treatment by Blasting]

The blasting apparatus 10 was filled with the blasting abrasive 1 according to Example 2 to perform blasting on a workpiece W, and the gloss of the workpiece W was compared before and after the blasting. A glass substrate which had been subjected to sandblasting using alumina-based abrasive WHITEMORUNDUM WA #1200 was prepared as a workpiece W. A wet type direct pressure blasting apparatus was used as the blasting apparatus 10. First, the blasting abrasive 1 according to Example 2 was stored in the blasting apparatus 10 (step S20). Next, the gas was heated (step S22). Finally, the blasting abrasive 1 according to Example 2 was injected onto the workpiece W with a heated gas of 0.2 MPa (step S24).

The surface of the workpiece W changed from a rough surface to a glossy surface before and after the blasting. It was confirmed that the glossy treatment on the workpiece W could be performed by applying the blasting abrasive 1 according to Example 2 to the blasting apparatus 10 and performing blasting.

REFERENCE SIGNS LIST

1 . . . blasting abrasive, 2 . . . particle, 3, 4 . . . abrasive grains, 10, 10A . . . blasting apparatus, 20 . . . storage container, 30 . . . heater, 40 . . . nozzle.

The invention claimed is:

1. A blasting abrasive to be injected to a workpiece together with gas, the blasting abrasive comprising:

a particle consisting of hot melt resin; and abrasive grains to be firmly fixed to the particle, wherein a change in rubber hardness of the hot melt resin is 1.3 (A) or more with respect to a temperature change of 1° C. in the temperature range of 20° C. to 50° C., and wherein the abrasive grains include abrasive grains firmly fixed in such a way as to be wholly buried in the particle, and the abrasive grains firmly fixed in such a way as to be wholly buried are distributed more in a vicinity of the surface of the particle than in a center of the particle.

2. The blasting abrasive according to claim 1, wherein the hot melt resin includes any one of ethylene vinyl acetate and polyurethane as a main component.

3. The blasting abrasive according to claim 1, wherein the abrasive grains include abrasive grains firmly fixed in such a way as to be partially buried from a surface of the particle to an inside of the particle in a radial direction thereof, and exposed from the surface of the particle to an outside of the particle in the radial direction thereof.

* * * * *